US008915980B2

(12) United States Patent
Hanrott

(10) Patent No.: US 8,915,980 B2
(45) Date of Patent: Dec. 23, 2014

(54) GASIFICATION APPARATUS WITH CONTINUOUS SOLIDS DISCHARGE

(75) Inventor: Christoph Hanrott, Muenster (DE)

(73) Assignee: UHDE GmbH, Dortmund (DE)

( * ) Notice: Subject to any disclaimer, the term of this patent is extended or adjusted under 35 U.S.C. 154(b) by 1011 days.

(21) Appl. No.: 12/737,429

(22) PCT Filed: Jul. 11, 2009

(86) PCT No.: PCT/EP2009/005059

§ 371 (c)(1),
(2), (4) Date: Mar. 23, 2011

(87) PCT Pub. No.: WO2010/006747

PCT Pub. Date: Jan. 21, 2010

(65) Prior Publication Data

US 2011/0168648 A1 Jul. 14, 2011

(30) Foreign Application Priority Data

Jul. 15, 2008 (DE) ..... 10 2008 033 094

(51) Int. Cl.

| | |
|---|---|
| ***C10J 3/46*** | (2006.01) |
| ***B01J 7/00*** | (2006.01) |
| ***C10J 3/52*** | (2006.01) |
| ***C10J 3/84*** | (2006.01) |

(52) U.S. Cl.

CPC .... *C10J 3/52* (2013.01); *C10J 3/84* (2013.01); *C10J 3/526* (2013.01); *C10J 2300/1628* (2013.01)

USPC ..... 48/197 R; 48/62 R; 48/127.1; 48/127.9; 48/61; 48/76; 48/69; 48/200; 48/201; 48/202; 48/203; 48/77; 48/71; 48/72; 48/73; 48/127.5; 48/127.3; 48/204; 48/89; 422/139

(58) Field of Classification Search

USPC ..... 48/197 R, 62 R, 127.9, 127.1, 76, 77, 71, 48/72, 73, 200, 201, 202, 203, 204, 127.5, 48/127.3; 422/139

See application file for complete search history.

(56) References Cited

U.S. PATENT DOCUMENTS

| | | | | |
|---|---|---|---|---|
| 4,073,628 | A | 2/1978 | Gernhardt et al. | |
| 4,192,654 | A * | 3/1980 | Brooks | 48/62 R |
| 4,377,066 | A * | 3/1983 | Dickinson | 60/775 |
| 4,381,924 | A | 5/1983 | Schmidt et al. | |

(Continued)

FOREIGN PATENT DOCUMENTS

| | | |
|---|---|---|
| CA | 1 194 696 A1 | 10/1985 |
| CA | 2 716 621 A1 | 9/2009 |

(Continued)

*Primary Examiner* — Kaity Handal

(74) *Attorney, Agent, or Firm* — Marshall & Melhorn, LLC

(57) ABSTRACT

A process for the discharge of slag and ash from a gasification reactor is disclosed. These solids are directed from the gasification reactor into a water bath housed with the gasification reactor in a pressure vessel. There are at least two lock hoppers underneath the water bath which are fed with a stream of water/solids via a pipe and a flow divider element, it being possible to supply the lock hoppers individually and in a controlled manner with a stream of water/solids via shut-off devices. The filling is performed in a manner that encourages the sett-ling process by withdrawing a stream of liquid from the lock hopper being filled, the filling time being controlled so as to prevent the solids settling above the valves and lock hoppers. Also disclosed is an apparatus with at least two lock hoppers underneath the water bath of a gasification reactor, there being, in an advantageous embodiment, a flow divider element and shut-off devices between the water bath and the lock hoppers.

12 Claims, 1 Drawing Sheet

(56) References Cited

U.S. PATENT DOCUMENTS

| | | | | | |
|---|---|---|---|---|---|
| 4,425,139 | A | | 1/1984 | Schmidt et al. | |
| 4,433,978 | A | | 2/1984 | Schenone et al. | |
| 4,704,137 | A | * | 11/1987 | Richter | 48/197 R |
| 5,545,238 | A | | 8/1996 | Brooker et al. | |
| 5,620,488 | A | * | 4/1997 | Hirayama et al. | 48/197 R |
| 5,851,497 | A | * | 12/1998 | Brooker et al. | 422/207 |
| 5,980,858 | A | | 11/1999 | Fujimura et al. | |
| 6,455,011 | B1 | * | 9/2002 | Fujimura et al. | 422/139 |
| 6,755,980 | B1 | * | 6/2004 | Van Den Born et al. | 210/767 |
| 7,198,655 | B2 | * | 4/2007 | Hogsett et al. | 44/621 |
| 2011/0100274 | A1 | * | 5/2011 | Kuske et al. | 110/347 |

FOREIGN PATENT DOCUMENTS

| | | | |
|---|---|---|---|
| DE | 28 29 629 | A1 | 1/1980 |
| DE | 31 44 266 | A1 | 7/1982 |
| DE | 32 07 215 | A1 | 9/1983 |
| DE | 32 20 624 | A1 | 11/1983 |
| DE | 32 44 742 | A1 | 6/1984 |
| DE | 25 56 957 | A1 | 6/1997 |
| EP | 0 085 221 | B1 | 8/1985 |
| EP | 0 290 087 | B1 | 9/1990 |
| EP | 0 800 569 | B1 | 6/2001 |
| WO | WO 2009/109297 | A2 | 9/2009 |

* cited by examiner

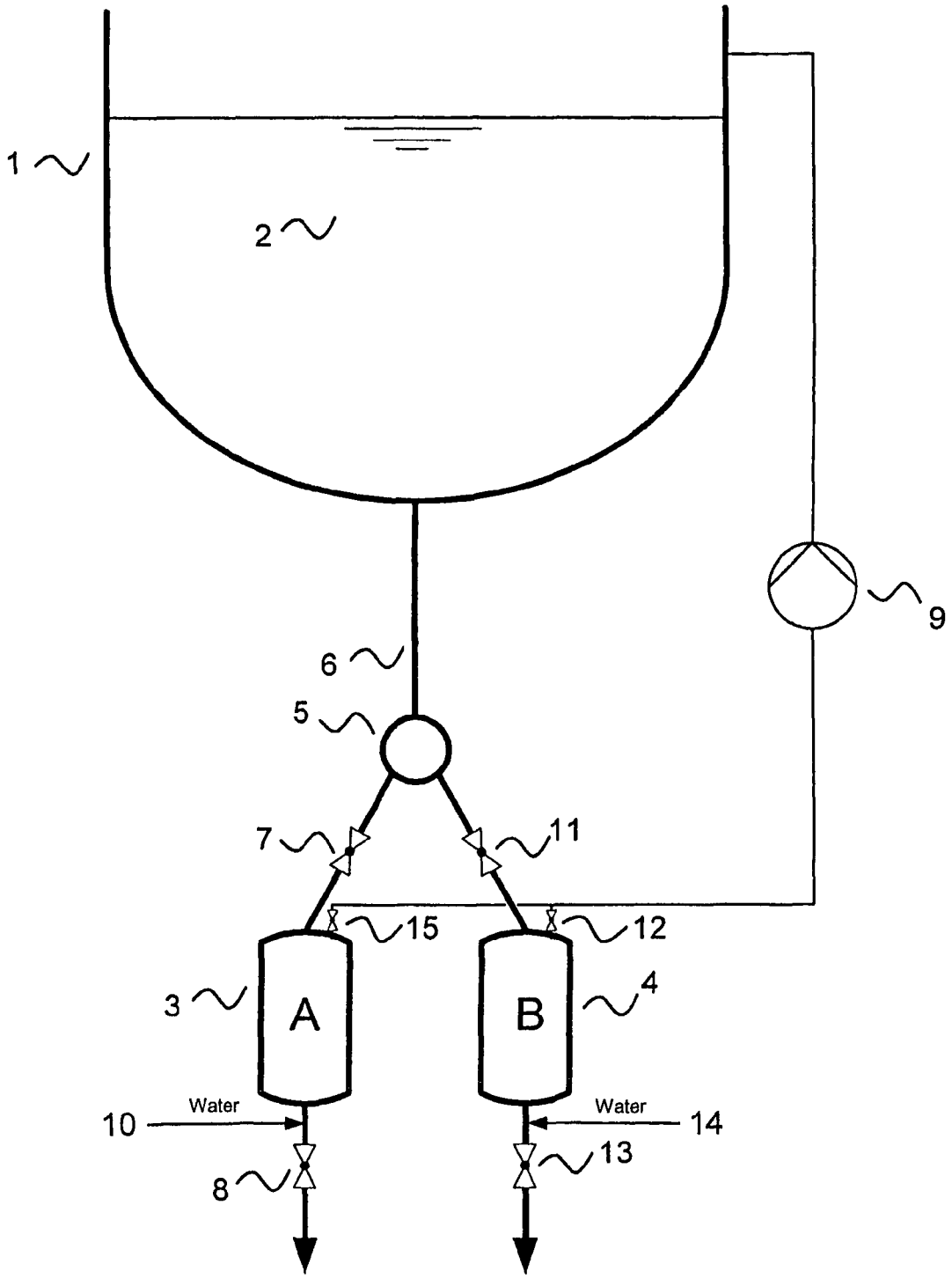
1
2
9
6
5
7
11
15
12
3
A
B
4
Water
Water
10
14
13
8

GASIFICATION APPARATUS WITH CONTINUOUS SOLIDS DISCHARGE

BACKGROUND OF THE INVENTION

The invention relates to a process and an apparatus for the discharge of solids which form during the gasification of finely dispersed, in particular solid fuels, particularly during coal gasification, the actual reactor for the production of synthesis gas having a bottom outlet for the slag and being housed within a pressure vessel and a water bath being provided underneath the reactor to collect the solids formed during the coal gasification, these solids being in the form of ash, slag and fly ash. The apparatus is designed so that the solids collected in the water bath are continuously removed and directed into at least two different lock hoppers and said solids accumulate in at least one lock hopper at any one time.

The production of synthesis gas from carbon-containing fuels generally incurs the formation of solids which have to be removed from the process. Examples include ash or slag. DE 3144266 A1 and EP 800569 B1 describe a process in which the ash and slag formed in a gasification system operated under pressure are collected in a water bath, also known as a quench zone. The particles of ash and slag are discharged in batches from the gasification system in a downwards direction via a lock hopper underneath the gasification system. For this, there are shut-off devices above and below the lock hopper to separate the lock hopper from the gasification system on the fluid side. While the lock hopper is being filled with slag, it is connected to the gasification apparatus. To empty the lock hopper when it is full of slag, the lock hopper is separated from the water bath by closing the upper shut-off devices and depressurised before the slag is discharged by opening the lower shut-off devices. After being emptied, the lock hopper is refilled with water and reconnected to the water bath. During slag discharge, the slag accumulates in the water bath.

EP 290087 B1 also describes a process for the removal of slag from an apparatus for the gasification of coal. In the described apparatus there is also a lock hopper underneath the pressure vessel which can be separated from the pressure vessel using valves. The slag is also discharged in batches. During the discharge, the slag is collected in a water bath, also known as a slag quench vessel. EP 290087 B1 states that separation by means of a valve and the accumulation of slag above the valve may lead to slag bridging directly across the valve. This bridging causes problems during operation when the lock hopper is reconnected to the pressure vessel. In EP 290087 B1 this bridging is solubilised by means of a gas bubble inside the lock hopper, this gas bubble being at a lower pressure than in the pressure vessel.

U.S. Pat. No. 6,755,980 B1 describes an apparatus for the removal of slag, said apparatus having an additional intermediate vessel between the pressure vessel and the lock hopper. Again, the slag is discharged in batches by means of valves above and below the lock hopper. During discharge of the slag collected in the lock hopper, the slag accumulating in the water bath is collected in the intermediate vessel. Again, bridging is described on the closed valve which may likewise lead to problems. Here, the danger of bridging is reduced by discharging a stream of water from the lock hopper.

The processes described are characterised by crucial disadvantages. Discharging the solids in batches by means of a lock hopper requires an intermediate vessel or additional capacity inside the pressure vessel to hold the amount of solids which accumulate during discharge. Emptying the lock hopper batchwise also puts a great strain on the apparatus connected to it. The apparatus connected to it must be designed for large amounts of solids discharged in batches and not for the much smaller average solids process stream. Furthermore, separating the lock hopper by means of valves leads to bridging on the valves and thus to problems in discharging the solids after reconnecting the lock hopper.

Therefore, the objective is to find a process and an apparatus for the discharge of solids formed during gasification, in particular during coal gasification, which obviate the need for an intermediate vessel or additional capacity inside the pressure vessel to hold the amount of solids which accumulate during discharge. The objective is also to increase the amount of solids discharged per hour without changing the dimensioning of the lock hoppers and the upstream/downstream equipment. At the same time, the objective is also to avoid blockages on the lock hopper valves and thus also maloperation.

The invention achieves this objective in the form of a process for the discharge of slag and ash from an apparatus for the gasification of fuels, the actual gas generator having a bottom outlet for solids and being housed within the pressure vessel, with a water bath underneath the gas generator to collect the solids formed in the gas generator, and the solids from the water bath being directed via a flow divider element and subsequent shut-off devices into at least two different lock hoppers, where they are reduced in pressure.

What is claimed, in particular, is a process for discharging solids from a gasification apparatus for the production of synthesis gas, in which the solids from the gasification apparatus are directed into a water bath positioned underneath the gas generator, said gasification apparatus having a bottom outlet for solids and being inside a pressure vessel, the process being characterised in that the solids stream or the solids suspension from the water bath housed within the pressure vessel is directed into two or more lock hoppers simultaneously or consecutively by means of a flow divider mechanism made up of a flow divider element and two or more subsequent shut-off devices, the lock hoppers being connected directly or indirectly to the pressure vessel via a flow divider element, and the solids stream or the solids suspension from the water bath for collecting the solids formed in the gasifier is fed into the lock hopper or hoppers, where it is subsequently reduced in pressure.

Synthesis gas can be produced, for example, by means of a coal gasification process. The coal gasification reaction takes place in a pressure vessel which contains the coal gasification reactor as well as fixtures for supplying the feedstocks and fixtures for discharging the synthesis gas and the solids formed. In a common embodiment the solids are removed from the reactor in a downwards direction, there first being apparatus connected to the bottom of the coal gasification reactor in descending order to separate the solids from the synthesis gas, and to cool and discharge the synthesis gas as well as an apparatus to collect the hot solids and ash particles. This is typically a water bath. The water bath is usually connected to two lock hoppers below it.

Devices for scrubbing, drying and removing the solids are attached to the downstream end of the lock hoppers. The two lock hoppers are alternately connected to and separated from the water bath by means of shut-off devices above the lock hoppers. While one lock hopper is in contact with the liquid in the water bath and being filled with solids, the second lock hopper is emptied. The solids are encouraged to settle out in the lock hopper by discharging a stream of liquid from the lock hopper which is connected. As soon as the second lock hopper has been emptied, it is filled with water and then reconnected to the pressure vessel. As soon as the first hopper has been filled to its maximum level, the stream of liquid to encourage the solids to settle out is no longer discharged from the first lock hopper but from the second.

In so doing, the solids stream is diverted to the second hopper and the first lock hopper can be separated from the pressure vessel by closing the valve, without it being affected by the solids, thus largely preventing the settlement of solids on the valve. This continuous alternate operation of the lock hoppers allows a higher solids throughput to be achieved without having to modify the upstream/downstream plant components as the amount of solids discharged when the lock hopper is emptied does not increase.

BRIEF SUMMARY OF THE INVENTION

An advantageous embodiment of the invention envisages the maintenance of a stream of solids/water from the water bath to at least one lock hopper by discharging a solids-depleted water stream from the lock hopper connected to the pressure vessel while the solids inside the lock hopper are settling out. The stream of water is withdrawn, for example, by means of suitable conveyor equipment, for instance pumps, or discharged to the outside by reducing the pressure. The liquid withdrawn can also, for example, be returned to the pressure vessel at a point above or below the water level of the water bath. For this purpose, there may be filtering devices at any point in the pipes.

It is also of advantage that a second hopper is connected to the pressure vessel before the hopper filled with solids is separated therefrom. Typically, the second lock hopper is filled with water and connected to the pressure vessel just before the first hopper filled with solids is separated therefrom. It is also of advantage that, during operation with two lock hoppers, filling of the lock hopper in contact with the water bath goes on at least until the second hopper can be emptied and the necessary steps for this can be taken. The necessary steps include, for example, pressurising and reducing the pressure of the lock hopper, cooling the contents of the lock hopper, opening and closing the shut-off devices and filling the lock hopper with water.

In order to facilitate operation, it is also possible to introduce a liquid stream into the bottom section or the bottom nozzle of the lock hopper during filling of said lock hopper. This can prevent deposits in the bottom section of the lock hopper or in the nozzles or pipes connected thereto.

It is also possible to configure the process so that flow division is controlled via a specially designed intermediate vessel with at least two different outlets, to which the lock hoppers are connected. For better discharge of the solids, the solids vessel may be tapered towards the outlets on the inside. The lock hoppers are selected via interposed valves.

BRIEF DESCRIPTION OF THE DRAWINGS

FIG. 1 shows an embodiment of a lock hopper system of a coal gasification unit.

DETAILED DESCRIPTION OF THE INVENTION

What is also claimed is an apparatus for the discharge of solids from a gasification reactor for the gasification of carbon-containing fuels, comprising a gasification reactor housed in a pressure vessel, and a water bath underneath the gasification reactor that is also housed within the pressure vessel, and a flow divider mechanism consisting of a flow divider element and at least two shut-off devices, and at least two lock hoppers, and that is characterised in that the water bath is connected to the flow divider element via connecting fixtures, the lock hoppers are connected to the flow divider element via two or more separate connecting fixtures and there are shut-off devices between the flow divider element and the lock hoppers with which the lock hoppers can be shut off from the flow divider element.

The flow divider element may, for example, be in the form of a divider switch. However, it may also be in the form of a flat plate with outlets, a hemispherical shell with outlets or a horizontal cylinder with outlets. In the case of the shut-off devices and shut-off elements any conceivable type of design is possible. The connecting fixtures are preferably in the form of pipes; however they may also be designed as flange fixtures and in principle they may be of any kind. The flow divider element is preferably designed as a simple pipe switch, but may also be a simple pipe connection, and in principle it may be of any kind. The shut-off devices are preferably ball valves.

It is also possible to use an intermediate vessel which has two or more outlets and is tapered on the inside towards these outlets in place of the flow divider element. There are shut-off devices between the intermediate vessel and the lock hoppers, with which the lock hoppers can be shut off from the intermediate vessel. What is also claimed is an apparatus for discharging solids from a gasification reactor for the gasification of carbon-containing fuels which is characterised in that the flow divider mechanism consists of an intermediate vessel with connecting fixtures for discharge, the intermediate vessel being tapered on the inside towards the connecting fixtures for discharge and being connected to the lock hopper via these connecting fixtures, and in that there are shut-off devices between the intermediate vessel and the lock hoppers with which the lock hoppers can be shut off from the flow divider element.

Finally, it is also possible to design the apparatus so that the flow divider mechanism is integrated into the water bath. Advantageously, this is done in such a way that the water bath has at least two different connecting fixtures for discharge, each of which empties into the lock hoppers, and the connecting fixtures for discharge from the water bath are equipped with shut-off devices, with which the lock hoppers can be separated from the water bath. This enables the solids stream or the solids suspension to be routed to the lock hoppers via the shut-off devices. The solids stream or the solids suspension is split into two in the water bath. In an advantageous embodiment of the invention the water bath is tapered towards the discharge pipes on the inside.

The invention is illustrated in greater detail on the basis of a diagram although the process in accordance with the invention is not restricted to this embodiment.

FIG. 1 shows an embodiment of a lock hopper system of a coal gasification unit which consists of a pressure vessel (1) with a water bath (2) to collect the slag and ash which accumulates during gasification, as well as lock hopper A (3) and lock hopper B (4) which are connected to the pressure vessel via a flow divider element (5). The solids are removed from the water bath (2) and directed to lock hopper A via a pipe (6) and the flow divider element (5). At this point in time, the valve (7) above lock hopper A is open and the valve (8) below lock hopper A is closed. A pump (9) discharges a stream of water from vessel A, thus aiding the solids stream in the direction of lock hopper A. Water is introduced into the bottom nozzle of lock hopper A via a pipe (10) in order to prevent deposits in the nozzle or the bottom tapered section. Lock hopper B is separated from the pressure vessel by closing the valve (11) above lock hopper B and the valve (12) between lock hopper B and the pump (9). The solids from lock hopper B are directed into the subsequent system by opening the valve (13) below lock hopper B. The valve (13) is then closed again and lock hopper B is filled with water via additional fixtures. Thereupon, lock hopper B is reconnected to the pressure vessel by opening the upper valve (11). As soon as lock hopper A has been filled to maximum level with accumulated solids, the stream of water withdrawn by the pump (9) is no longer withdrawn from lock hopper A but from lock hopper B by closing the valve (15) between lock hopper A and the pump (9) and opening the valve (12) between lock hopper B and the pump (9). This stops the solids stream to lock hopper A and diverts it to lock hopper B. While lock hopper B is being filled, water is likewise injected into the bottom nozzle of hopper B via a pipe (14). Then the valve (8) above lock hopper A can be closed without it being affected by the solids and sluicing can begin in said lock hopper. This is done by opening the valve (8) below the lock hopper.

LIST OF REFERENCE NUMBERS AND DESIGNATIONS

1 Pressure vessel
2 Water bath
3 Lock hopper A
4 Lock hopper B
5 Flow divider element
6 Pipe
7 Valve
8 Valve
9 Pump
10 Water feed pipe
11 Valve
12 Valve
13 Valve
14 Water feed pipe
15 Valve

The invention claimed is:

1. A process for discharging solids from a gasification apparatus for the production of synthesis gas, in which the solids from the gasification apparatus are directed into a water bath positioned underneath the gasification apparatus, said gasification apparatus having a bottom outlet for solids and being inside a pressure vessel, the process comprising:

directing the solids stream or the solids suspension from the water bath housed within the pressure vessel into two or more lock hoppers simultaneously or consecutively by means of a flow divider mechanism comprising a flow divider element and two or more subsequent shut-off devices, the lock hoppers being connected directly or indirectly to the pressure vessel via a flow divider element;

feeding the solids stream or the solids suspension from the water bath for collecting the solids formed in the gasifier into the lock hopper or hoppers, where it is subsequently reduced in pressure;

separating or connecting the lock hoppers to the liquid in the water bath by means of shut-off devices; and maintaining a continuous solids suspension stream in at least one lock hopper by returning a solids-depleted water stream from the lock hopper connected to the pressure vessel by means of conveyor equipment to the pressure vessel.

2. The process according to claim 1, wherein the second lock hopper is filled with water and connected to the pressure vessel before the first hopper filled with solids is separated therefrom.

3. The process according to claim 1, wherein the filling of the lock hopper in contact with the water bath takes at least as long as the emptying of the second lock hopper.

4. The process according to claim 1, wherein emptying a lock hopper comprises:

pressurizing and reducing the pressure of the lock hopper;

filling the lock hopper with water;

opening and closing the shut-off devices; and optionally cooling the contents of the lock hopper.

5. The process according to one of claim 1, wherein a liquid stream is introduced into the bottom section of the lock hopper connected to the pressure vessel by means of a pipe.

6. As apparatus for the discharge of solids from a gasification reactor for the gasification of carbon-containing fuels, comprising:

a gasification reactor housed in a pressure vessel;

a water bath underneath the gasification reactor that is also housed within the pressure vessel;

a flow divider mechanism comprising a flow divider element and at least two shut-off devices; and at least two lock hoppers; wherein the water bath is connected to the flow divider element via connecting fixtures; and the lock hoppers are connected to the flow divider element via two separate connecting fixtures, there being shut-off devices between the flow divider element and the lock hoppers with which the lock hoppers can be separated fluidwise from the flow divider element; and a return pipe to the water bath is provided between each lock hopper and conveyor equipment is arranged in this return pipe.

7. The apparatus according to claim 6, wherein:

the flow divider mechanism comprises an intermediate vessel with connecting fixtures for discharge, the intermediate vessel being connected to the lock hoppers via these connecting fixtures; and there are shut-off devices disposed between the intermediate vessel and the lock hoppers with which the lock hoppers can be separated fluidwise from the flow divider element.

8. The apparatus according to claim 7, wherein the intermediate vessel is tapered towards the connecting fixtures for discharge on the inside.

9. The apparatus according to claim 6, wherein:

the water bath has at least two or more connecting fixtures for discharge, each of which empties into the lock hoppers; and the connecting fixtures for discharge from the water bath are equipped with shut-off devices, with which the lock hoppers can be separated fluidwise from the water bath.

10. The apparatus according to claim 9, wherein the water bath is tapered towards the connecting fixtures for discharge on the inside.

11. The apparatus according to claim 6, wherein the flow divider mechanism is designed in the form of one of:

a flat plate with outlets;

a hemispherical shell with outlets; and a horizontal cylinder with outlets to the lock hoppers; and shut-off devices are disposed in the outlets to the lock hoppers.

12. The apparatus according to claim 6 wherein the shut-off devices are ball valves.

* * * * *